US006599044B2

(12) United States Patent
Paris

(10) Patent No.: US 6,599,044 B2
(45) Date of Patent: Jul. 29, 2003

(54) DEVICE FOR PRINTING ON PAPER TAPE AND FOR CUTTING THE TAPE INTO PRINTED TICKETS

(75) Inventor: Eric Paris, Antony (FR)

(73) Assignee: Axiohm, Montrouge (FR)

( * ) Notice: Subject to any disclaimer, the term of this patent is extended or adjusted under 35 U.S.C. 154(b) by 56 days.

(21) Appl. No.: 10/013,083

(22) Filed: Dec. 10, 2001

(65) Prior Publication Data

US 2002/0069741 A1 Jun. 13, 2002

(30) Foreign Application Priority Data

Dec. 11, 2000 (FR) ..... 00 16058

(51) Int. Cl.[7] ..... B41J 11/70
(52) U.S. Cl. ..... 400/621; 101/93.07
(58) Field of Search ..... 400/621, 621.1; 101/93.07

(56) References Cited

U.S. PATENT DOCUMENTS 4,297,039 A * 10/1981 Lees ..... 400/691
5,022,771 A * 6/1991 Paque ..... 400/208
5,115,322 A * 5/1992 Jang ..... 358/304
5,553,954 A * 9/1996 Nakano ..... 400/621
5,560,725 A * 10/1996 Abergel ..... 400/621
6,113,293 A * 9/2000 Schanke et al. ..... 400/621
6,343,884 B1 * 2/2002 Watanabe et al. ..... 400/621
6,352,381 B1 * 3/2002 Gonmori et al. ..... 400/615.2

FOREIGN PATENT DOCUMENTS

| | | |
|---|---|---|
| EP | 0084347 | 7/1983 |
| EP | 0579477 | 1/1994 |
| EP | 0901890 | 3/1999 |

* cited by examiner

*Primary Examiner*—Andrew H. Hirshfeld
*Assistant Examiner*—Dave A. Ghatt
(74) *Attorney, Agent, or Firm*—George R. McGuire; Hancock & Estabrook, LLP

(57) ABSTRACT

The invention relates to a printer device for printing on a paper tape and for cutting the tape into printed tickets. The device comprises a frame having a cover hinged on the frame, a printer, cutter means, and guide means for guiding the tape between the printer and the cutter means. According to the invention, the guide means are formed by two walls substantially parallel to the axis of a paper drive roller, one wall being carried by the cover and the other wall being carried by the frame, in such a manner as to impose an S-bend on the portion of the tape that extends between the printer and the cutter means.

6 Claims, 2 Drawing Sheets

DEVICE FOR PRINTING ON PAPER TAPE AND FOR CUTTING THE TAPE INTO PRINTED TICKETS

The invention relates to a device for printing on paper tape and for cutting the tape into printed tickets, more precisely it relates to a device for printers of the type comprising a thermal print head carried resiliently by a frame, and a tape-drive roller or "capstan" carried by a cover and parallel to a hinge axis, with the print head co-operating in operation with the roller by bearing against a generator line thereof.

BACKGROUND OF THE INVENTION

Numerous variant embodiments of ticket printing and dispensing devices of the above type are already in existence and they can be classified as closed devices and as open device.

In closed devices, there is generally a moving cap which enables a roll of tape to be inserted into a paper compartment and means for threading the leading end of the tape between the head and the capstan and between two blades of the cutter device.

In open devices, there is a frame and a cover, one carrying the print head and the other the capstan, so the capstan and the print head can be moved apart from each other in order to place the leader of the tape between them without it being necessary to have means for inserting and threading said end. In general, such devices have a cutter device downstream from the print unit, which cutter can be static (with cutting being performed by pulling on the ticket) or it can be motor driven. When motor driven, the motor-driven cutter device can be of the opening kind having one blade carried by the cover and another blade carried by the frame (in general this is the motor-driven blade), or else it can be of the non-opening type.

Static cutter devices are subject to random operation because of intervention by the user who exerts traction more or less correctly for detaching the ticket.

Opening motor-driven cutter devices are complex mechanically and subject to frequent breakdowns because of the play which exists between the two blades specifically because they can be separated.

Finally, non-opening cutter devices generally include paper guide means upstream from the cutter blades which form a tunnel making it awkward to engage the leader end of the tape each time the roll is changed.

OBJECTS AND SUMMARY OF THE INVENTION

The present invention provides a remedy to the drawbacks of all known devices by using a printer structure which opens and a cutter device structure which does not open but which has simplified access.

To this end, the invention provides a device for printing a paper tape and for cutting the tape into printed tickets, the device comprising a frame with a cover hinged to the frame, a printer comprising a thermal print head carried resiliently by the frame and cooperating in operation by bearing against a generator line of a tape drive roller mounted to rotate on the cover, cutter means downstream from the print head in the tape drive direction comprising a fixed blade whose cutting edge extends parallel to the axis of the drive roller and a knife that is movable along the edge of the fixed blade, and guide means for guiding the tape between the printer and the cutter means, wherein the guide means are formed by two walls substantially parallel to the axis of the roller, one of the walls being carried by the cover downstream from the roller and the other wall being carried by the frame upstream from the cutting edge of the fixed blade, the walls imposing an S-bend on the portion of tape that extends between the printer and the cutting edge of the fixed blade.

This S-bend confers stiffness to the portion of tape that facilitates the cutting operation since the tape is then better at withstanding the lateral drive forces to which it is subjected while the knife passes along the edge of the fixed blade.

In preferred manner, the cutting edge is constituted by a downstream edge of the fixed wall.

In this way, the functions of guidance and of cutting are performed by the same element.

The moving knife is then advantageously carried by a carriage that moves parallel to the edge of the fixed blade, and the fixed blade is longer than the width of the paper tape so that the portion thereof projecting beyond the tape forms a parking zone for the moving knife.

Thus, clearing a passage for the tape leader while it is being put into place is achieved merely by placing the moving knife in the parking zone.

The moving carriage is advantageously actuated by a wormscrew extending parallel to the edge of the fixed blade.

The carriage is thus easily displaced using a motor to drive the wormscrew.

BRIEF DESCRIPTION OF THE DRAWINGS

Other characteristics and advantages of the invention will appear more clearly in the light of the following description of a particular non-limiting embodiment of the invention, given with reference to the figures, in which.

MORE DETAILED DESCRIPTION

Figure 1:
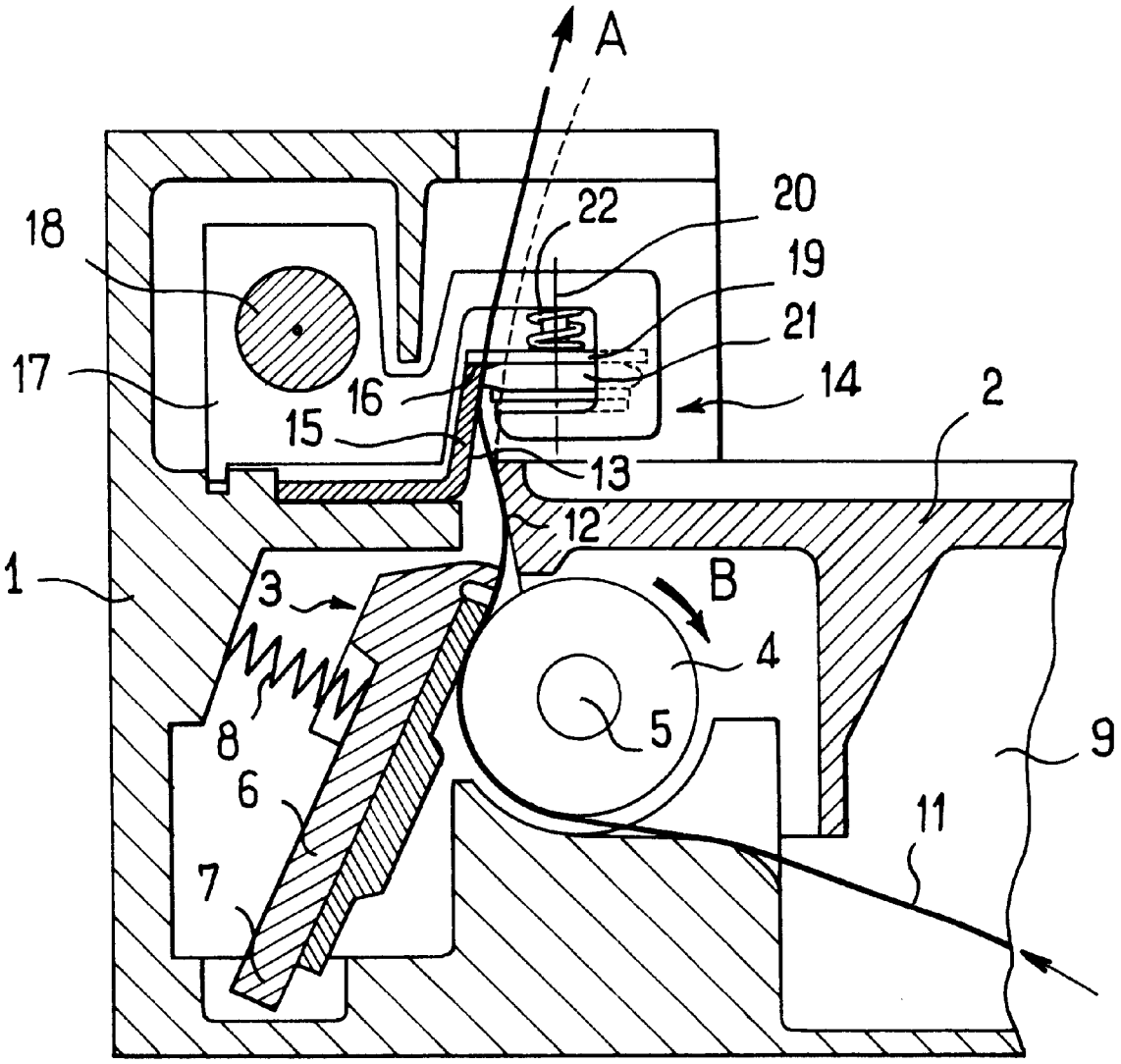
FIG. 1 is a fragmentary section view of a device of the invention.
Figure 2:
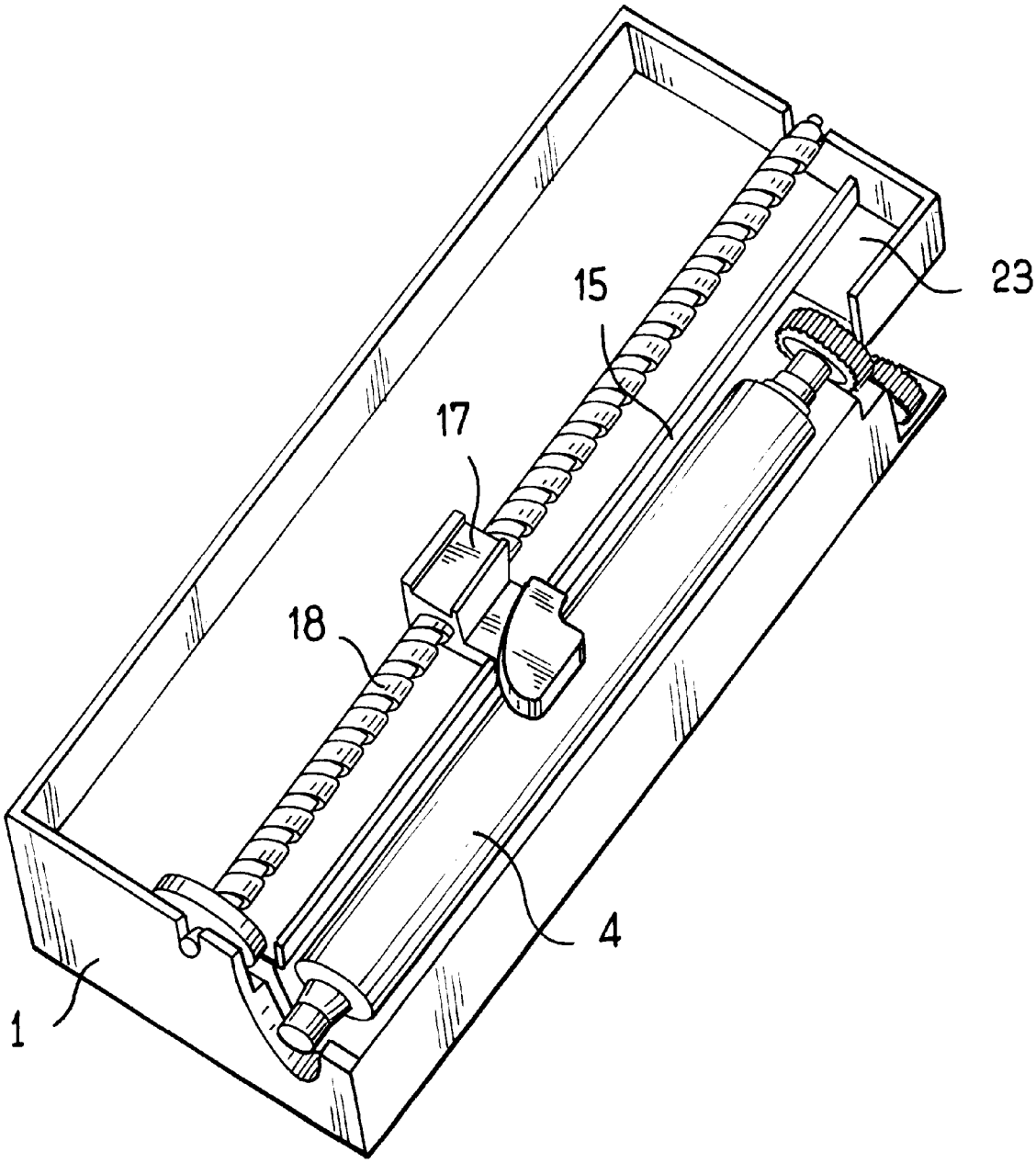
FIG. 2 is a simplified perspective view of the same device, with the cover 2 omitted.

With reference to the figures, a printer device of the invention comprises a fixed frame 1 having a moving frame portion hinged thereto to form a cover 2. The cover 2 closes a compartment 9 for receiving a roll of paper tape 11.

The device of the invention is fitted with a printer given overall reference 3, comprising a paper drive roller 4, said roller being mounted to rotate about an axis 5 relative to the cover 2. When the cover 2 is in the closed position, the drive roller 4 co-operates with a thermal print head 6 mounted on the fixed frame 1 to pivot about an axis 7 against a spring 8 bearing against the fixed frame 1 and causing the print head 6 to be pressed against the drive roller 4.

The paper 11 is driven by rotating the drive roller 4 in the direction indicated by the arrow, and it is printed as it passes under the print head 6. The drive roller 4 is rotated by a motor which is carried by the fixed frame 1 and not shown in the figures. The connection between the motor and the drive roller 4 can be obtained, for example, by meshing between a first gearwheel carried by the shaft of the motor and a second gearwheel carried by the drive roller 4 at an axial end thereof, with meshing being obtained when the cover 2 is closed.

At the outlet from the printer 3, the paper 11 is deflected by a deflector wall 12 forming part of the cover 2 and deflecting the paper 11 towards cutter means having general reference 14. This deflector wall 12 imparts a first bend to the paper tape 11 as it leaves the printer 3. The tape is thus deflected towards a second deflector wall 13 that is stationary, being secured to the frame 1, and which imparts a second bend to the paper tape 11 immediately upstream from the cutter means 14.

The cutter means 14 is carried by the fixed frame 1 and is constituted firstly by a fixed blade 15 which in the embodiment shown is constituted by the fixed wall 13 itself which has a downstream edge (towards the top in the figure) forming a cutting edge 16 parallel to the axis of rotation 5 of the drive roller 4.

The cutter means 14 also comprises a carriage 17 mounted to move in translation on the fixed frame 1 along the direction of the cutting edge 16 of the blade 15. The carriage 17 is driven by a wormscrew 18, itself driven by a motor that is not shown.

The carriage 17 carries a moving knife 19 which in this case is in the form of a disk, the knife 19 being mounted to rotate freely about an axis 20 that is substantially perpendicular to the cutting edge 16 of the fixed blade 15. The cutting edge of the moving knife 19 as constituted by the bottom edge of the disk crosses the cutting edge 16 of the fixed blade 15 so as to cut the paper by a scissors effect. A spring 22 placed on the axis 20 urges the moving knife 19 against the cutting edge 16 of the fixed blade 15 so that the cutting edges of the two blades are always in contact.

A presser ring 21 for pressing the paper 11 against the fixed wall 13 is provided about the axis 20 so as to press the paper 11 against said fixed wall 13 and thus ensure better cutting.

The stroke of the carriage 17 (and thus the length of the wormscrew 18) is longer than the width of the paper tape 11 so as to provide a parking space 23 on the fixed frame 1 for receiving the carriage 17 when it is returned to the beginning of its stroke after performing an operation of cutting off a ticket. The fixed blade 15 is also of sufficient length to guarantee that the cutting edges of the fixed blade 15 and of the moving knife 19 remain in contact over the entire stroke of the carriage 17, including when the carriage 17 is positioned in the parking space 23. Permanent contact between the two cutting edges eliminates any docking impact between the moving knife and the fixed blade, and thus eliminates any risk of the cutting edges being damaged.

This parking space 23 serves firstly to disengage the working portion of the cutting edge 16 of the fixed blade 15 completely so as to facilitate insertion of the paper 11 when changing the roll (it suffices to put the roll into place, to pull on the tape leader, and to close the cover 2). This parking space 23 also enables the passage for the drive roller 4 to be left clear while the cover 2 is being opened so as to avoid any interference. The surface of the volume swept by the cover 2 while it is being opened is represented diagrammatically by dashed lines in the figure.

The dispositions of the invention relate to guiding the paper tape 11, thereby making it possible to use non-opening cutter means as described above, so as to benefit from the advantages of such means. With such means; the fixed blade 15 and the moving carriage 17 carrying the moving knife 19 are never separated so that play in operation or positioning tolerances which can lead to poor operation of the cutter means 14 are reduced to a minimum. As stated above, it is also possible to guarantee that permanent contact is maintained between the two cutting edges, which is a factor contributing to longevity and to efficiency of the cutter means.

The two bends form an S-bend serving firstly to stiffen the paper before it passes through such cutter means 14, thereby preparing it to withstand the lateral cutting force which is applied thereto by said cutter means 14 as the moving knife 19 moves in translation along the cutting edge 16 of the fixed blade 15. This force has a component that is parallel to the cutting edge 16 in the translation direction of the moving knife 19, and the stiffening imparted to the paper by the S-bend ensures that the paper does not crease or crumple under the effect of this force component parallel to the cutting edge 16 when the moving knife 19 moves past. The two deflector walls also enable the cutter means 14 to be disposed in a position that is remote from the cover 2, thus enabling the cover to be opened or closed without interfering with the cutter means 14. Providing a parking space 23 in which the carriage 17 is located while the cover 2 is being moved also serves to limit this guard separation that is necessary to ensure that elements secured to the cover 2 (and in particular the drive roller 4) do not interfere with the fixed portion of the cutter means 14. This S-bend imparted by the deflector wall 12 and the fixed wall 13 thus enable such non-opening cutter means 14 to be fitted to printer devices of the opening type.

This arrangement of the deflector walls in accordance with the invention is particularly advantageous in devices where the printer 3 is arranged so that the resilient bearing force urging the print head 6 against the drive roller 4 opposes opening of the cover 2. Given that the effect of this arrangement is to impart a direction on the paper tape 11 downstream from the printer 3 such that the tape 11 goes away from the cutter means 14, the deflector wall 12 thus also has the function of deflecting the path followed by the paper tape 11 on leaving the printer 3 so that it goes towards the cutter means 14. It should be observed that with such printers, the deflection angle imposed on the paper by the wall 12 is relatively large, thus having the effect of giving rise to significant reaction from the paper due to its springiness. This reaction is advantageous since it encourages the tape to press against the wall 12 (which can be shaped), and thus improves guidance thereof and the accuracy of the path that it imposes.

The invention is not limited to the particular embodiment described above, and on the contrary it extends to any variant using equivalent means to reproduce the essential characteristics specified above.

In particular, the carriage can be driven by any equivalent means, for example of the cable type. The carriage can be driven into the parking space automatically when the cover 2 is opened.

The blade 19 can be constrained to rotate with the presser ring 21, and the pair of them can be driven so as to rotate with or without slip relative to the fixed blade 15. In a variant, the blade 19 can be mounted on the carriage 17 so that it is fixed, and it need not be circular.

What is claimed is:

1. A device for printing a paper tape and for cutting the tape into printed tickets, the device comprising a frame with a cover hinged to the frame, a printer comprising a thermal print head carried resiliently by the frame and co-operating in operation with a tape drive roller mounted to rotate on the cover, the print head bearing against a generator line of the roller, cutter means downstream from the print head in the tape drive direction comprising a fixed blade whose cutting edge extends parallel to the axis of the drive roller and a knife that is movable along the fixed blade, the cutting edge of the moving knife crossing the cutting edge of the fixed blade, and guide means for guiding the tape between the printer and the cutter means, wherein the guide means are formed by two walls substantially parallel to the axis of the roller, one of the walls being carried by the cover downstream from the roller and the other wall being carried by the frame upstream from the cutting edge of the fixed blade, the walls imposing an S-bend on the portion of tape that extends between the printer and the cutting edge of the fixed blade.

2. A device according to claim 1, wherein the cutting edge of the fixed blade is constituted by a downstream edge of the fixed wall.

3. A device according to claim 1, wherein the moving knife is carried by a moving carriage that moves parallel to the cutting edge of the fixed blade, and wherein the stroke of the moving carriage is longer than the width of the paper tape so as to enable a parking space to be provided for the moving carriage.

4. A device according to claim 3, wherein the fixed blade is of a length that is sufficient to enable the cutting edge of the moving knife to be kept permanently crossing the cutting edge of the fixed blade including when the moving carriage is positioned in the parking space.

5. A device according to claim 3, wherein the moving knife is a circular blade mounted to rotate on the moving carriage and wherein a presser ring for pressing the tape against the guide wall is mounted to rotate on the moving carriage.

6. A device according to claim 3, wherein the moving carriage is actuated by a wormscrew extending parallel to the cutting edge of the fixed blade.

* * * * *